US008083535B2

(12) United States Patent
Chang

(10) Patent No.: US 8,083,535 B2
(45) Date of Patent: Dec. 27, 2011

(54) USB CONNECTOR CAPABLE OF EXTRACTION PROOF

(76) Inventor: Nai-Chien Chang, Sanchong (TW)

( * ) Notice: Subject to any disclaimer, the term of this patent is extended or adjusted under 35 U.S.C. 154(b) by 0 days.

(21) Appl. No.: 12/711,123

(22) Filed: Feb. 23, 2010

(65) Prior Publication Data

US 2010/0279547 A1 Nov. 4, 2010

(30) Foreign Application Priority Data

Apr. 30, 2009 (TW) ..... 98207323 U

(51) Int. Cl.
*H01R 13/627* (2006.01)

(52) U.S. Cl. ..... 439/357

(58) Field of Classification Search ..... 439/357, 439/358, 352, 296, 660
See application file for complete search history.

(56) References Cited

U.S. PATENT DOCUMENTS 6,139,350 A * 10/2000 Mathesius ..... 439/357
6,902,432 B2 * 6/2005 Morikawa et al. ..... 439/607.41
2007/0254514 A1 * 11/2007 Weksler et al. ..... 439/296

FOREIGN PATENT DOCUMENTS

TW I273161 B 2/2007

* cited by examiner

*Primary Examiner* — Alexander Gilman
(74) *Attorney, Agent, or Firm* — Chun Ming Shih; HDLS IPR Services

(57) ABSTRACT

A USB connector with extraction-proof structure includes an insulation seat and a metallic shell. The insulation seat has a base, one side of which is extended a tongue, on which a plurality of conductive legs are disposed, another side of each of which passes through the base and extends out of the base. The metallic shell shown as a hollow configuration is assembled to the base and fitted onto the tongue to form a connection opening. In the meantime, a fastening piece is arranged on the top face of the metallic shell. After the USB metallic plug of an external device is plugged in the USB connector, the fastening piece fastens the perforations of the USB metallic plug for preventing the external device from being extracted and stolen.

4 Claims, 7 Drawing Sheets

USB CONNECTOR CAPABLE OF EXTRACTION PROOF

BACKGROUND OF THE INVENTION

1. Field of the Invention

The present invention in general relates to a connector, in particular, to a USB connector adapted for a connection with a device (e.g., USB flash drive), such that the device won't be extracted or stolen at will.

2. Description of Prior Art

Universal Series Bus or so-called USB is a serial bus standard connecting external device. Because of the biggest merit of supporting hot plugging and "plug-and-play", USB is comprehensively used in computer today. When a device is plugged in, computer mainframe will load driving software needed by this device, which is more convenient than using PCI and ISA serial bus.

Since of USB connector, USB plug of external device can be quickly plugged in and used simultaneously. But, there is no mechanism existing between the USB connector and the USB plug of the external device for preventing the extraction. Therefore, as long as the USB plug of the external device is still plugged in the USB connector, the external device in connection with the USB connector is easily extracted and stolen, when user leaves the computer.

Accordingly, as disclosed in ROC Patent No. I273161 and entitled "Locking Structure of USB Connector", a locking structure with password is additionally arranged on the USB connector. But, since this kind of locking structure is exposed to the outside, thief can easily get rid of password to steal the external device.

SUMMARY OF THE INVENTION

Therefore, in order to solve aforementioned problems, the invention is mainly to provide a USB connector adapted for fastening the USB metallic plug of an external device, such that the external device won't be stolen by a thief. When it is necessary to take away the external device, user can first dismantle the shell of the electronic product and then take down the external device by means of a tool to release the fastening state of the extraction proof structure on the USB structure.

Secondly, the invention is to provide a USB connector capable of extraction proof, including:

an insulation seat, which has a base, one side of which is extended a tongue, on which a plurality of conductive legs are disposed, another side of each of which passes through the base and extends out of the base; and a metallic shell, which is shown as a hollow configuration and assembled to the base, and which is fitted onto the tongue to form a connection opening, and on the top face of which a fastening piece is arranged;

After the USB metallic plug of an external device is plugged in the USB connector, the fastening piece fastens the perforations of the USB metallic plug.

BRIEF DESCRIPTION OF DRAWINGS

The features of the invention believed to be novel are set forth with particularity in the appended claims. The invention itself, however, may be best understood by reference to the following detailed description, which describes a number of embodiments of the invention, taken in conjunction with the accompanying drawings, in which:

DETAILED DESCRIPTION OF THE INVENTION

In cooperation with attached drawings, the technical contents and detailed description of the present invention are described thereinafter according to a number of preferable embodiments, not used to limit its executing scope. Any equivalent variation and modification made according to appended claims is all covered by the claims claimed by the present invention.

Figure 1:
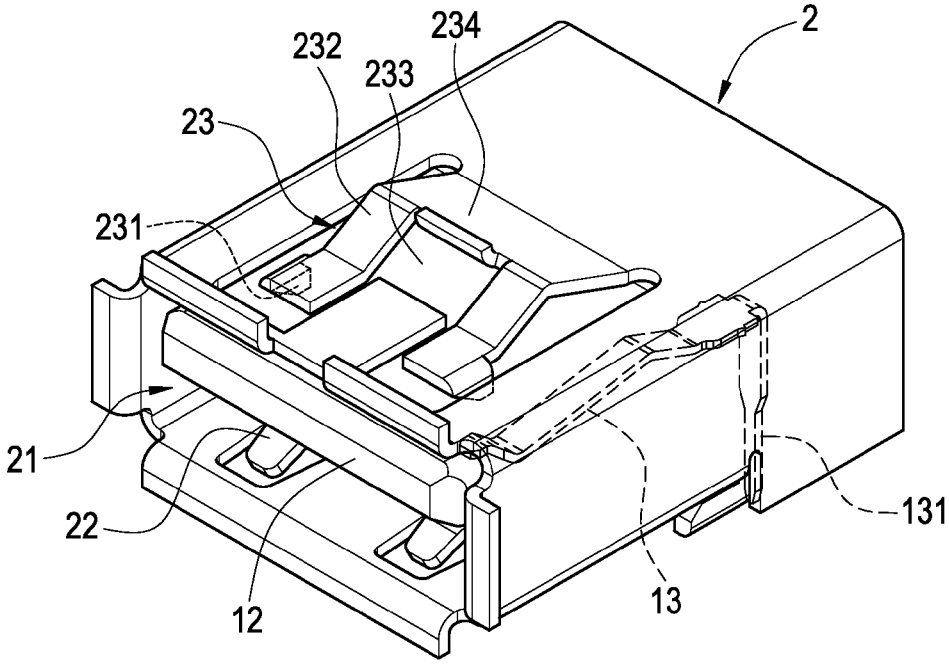
FIG. 1 is an outer illustration showing a USB connector according to the present invention.
Figure 2:
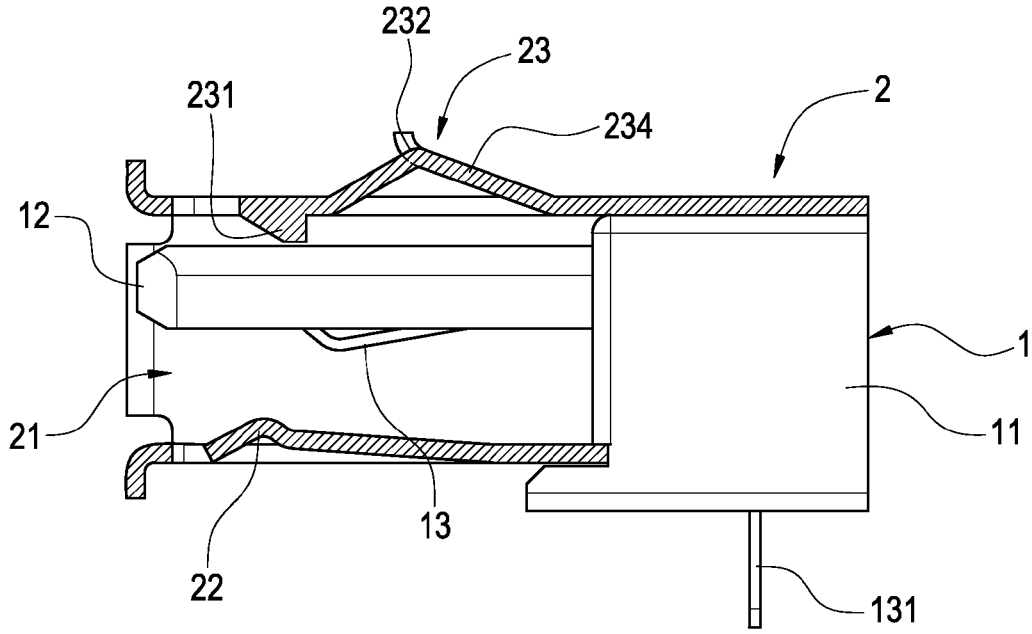
FIG. 2 is a laterally sectional illustration of a USB connector according to the present invention.

Please refer to FIG. 1 and FIG. 2, respectively showing an outer and a laterally sectional illustration of a USB connector according to the present invention. As shown in these two figures, the USB connector capable of extraction proof according to the invention includes an insulation seat 1 and a metallic shell 2.

The insulation seat 1 is arranged a base 11, one side of which is extended a tongue 12, on which a plurality of conductive legs 13 are disposed, another side portion 131 of each of which passes through the base 11 and extends to the outside of the base 11.

The metallic shell 2 shown as a hollow shape is assembled onto the base 11 and encloses the tongue 12, such that a connection opening 21 is formed in the metallic shell 2 and adapted for the USB metallic plug of an external device (not shown in the figures) to be plugged in. In addition, a plurality of leaf springs 22 are arranged at the bottom of the metallic shell 2. After the USB metallic plug of the external device is plugged in, the leaf springs 22 are then abutted against the surface perforations of the USB metallic plug of the external device. Moreover, the metallic shell 2 is arranged a fastening piece 23 shown as a rake shape with a "<"profile, at the front of which a fastening part 231 shown as a barb shape is arranged. In this case, after the USB metallic plug of the external device is plugged in, the fastening part 231 is buckled into the perforation arranged on the surface of the USB metallic plug (not shown in the figures). Meanwhile, two lateral sides of the bending part 232 shown as "<"shape are respectively arranged an opening 233 and an abutting part 234. After an external tool (not shown in the figures) is inserted into the opening 233 and pushes up the abutting part 234, the fastening part 231 leaves the perforation 43 of the USB metallic plug 41 to get rid of a fastening action of the fastening piece 23.

Figure 3:
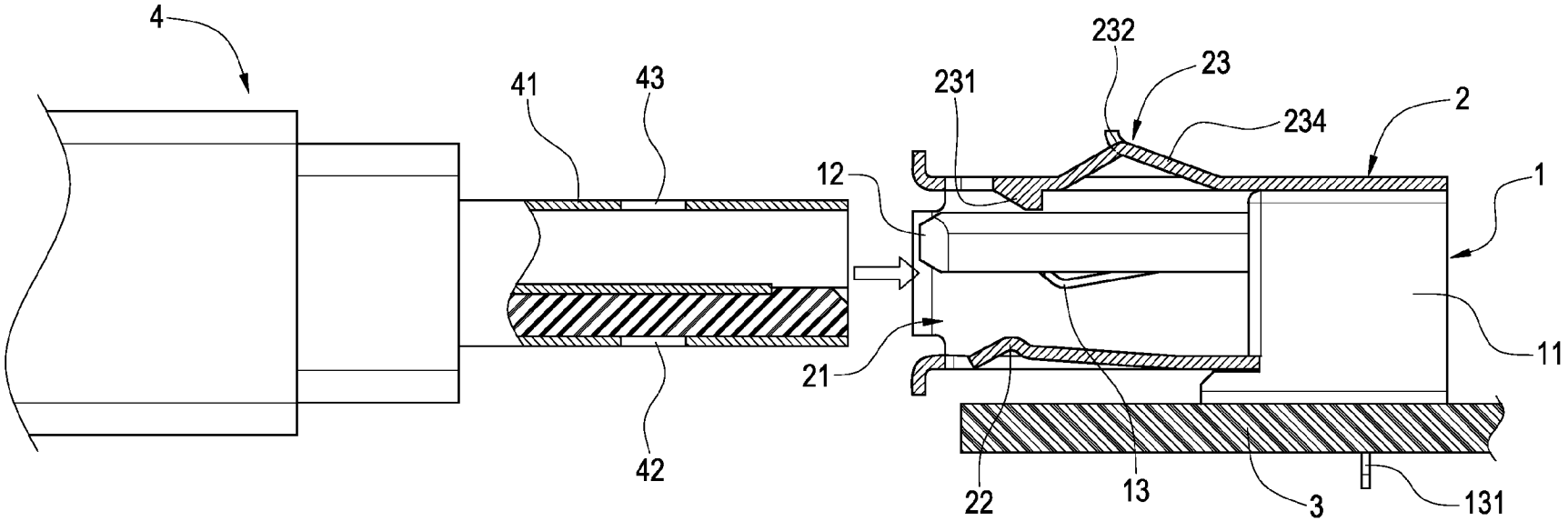
FIG. 3 is an action illustration showing that the USB metallic plug of an external device of the invention has not been plugged in a USB connector.
Figure 4:
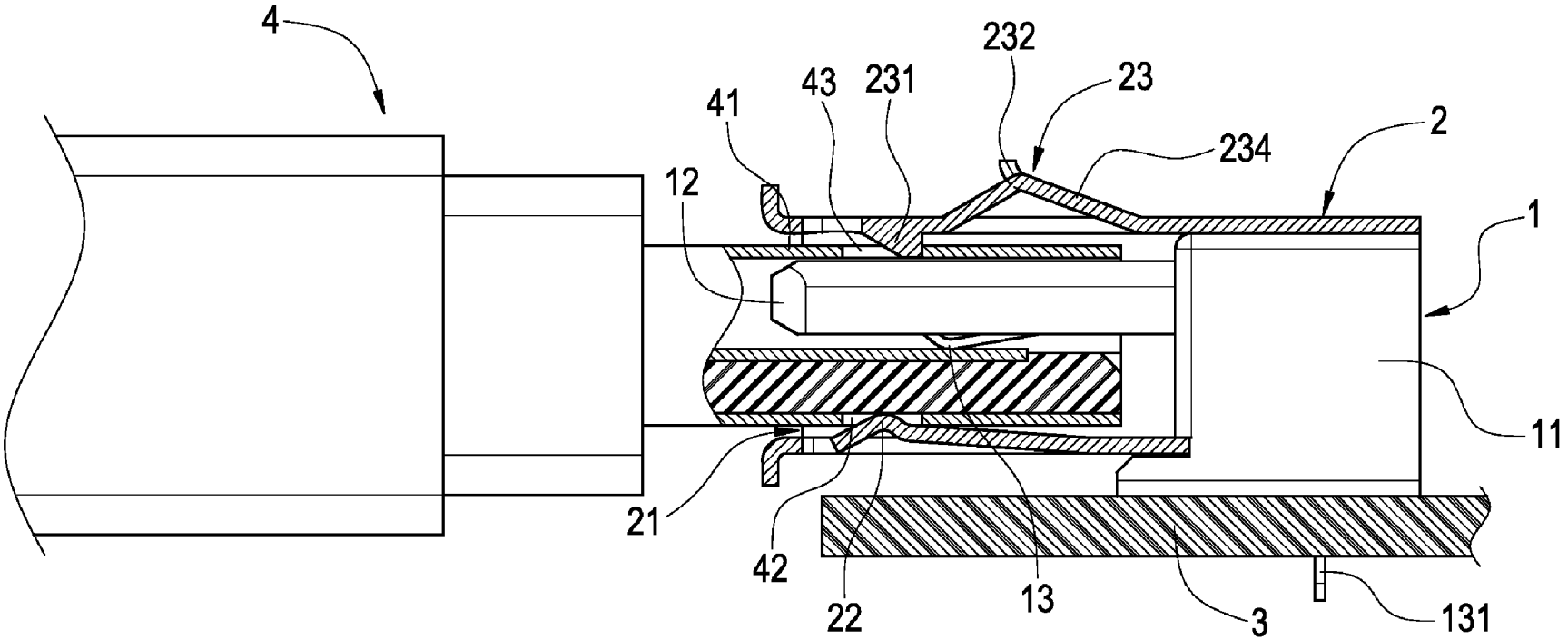
FIG. 4 is an action illustration showing that the USB metallic plug of an external device of the invention has already been plugged in a USB connector.

Please refer to FIG. 3 and FIG. 4, which respectively are two action illustrations of the USB metallic plug of an external device before and after being plugged in a USB connector. As shown in these two figures, after the USB connector of the invention is installed to the motherboard 3 of an electronic product (computer) and the USB metallic plug 41 of an external device 4 (USB flash drive) is plugged in the connection opening 21 of the USB connector, the leaf spring 22 and the fastening part 231 of the fastening piece 23 are buckled into the perforations 42, 43 of the USB metallic plug 41, such that the external device 4 won't be extracted and stolen by thief.

Figure 5:
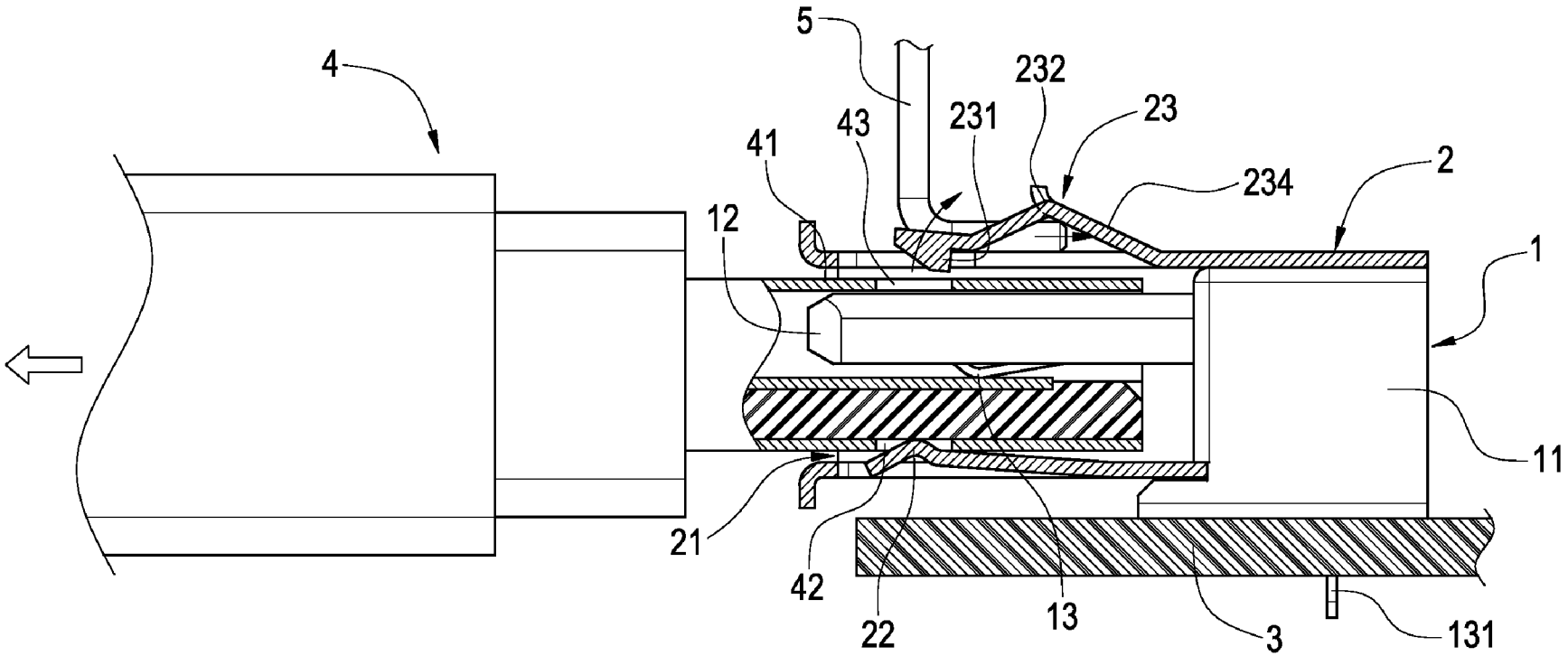
FIG. 5 is an illustration showing a releasing state, in which the USB metallic plug of an external device of the invention has been unplugged from a USB connector.

Please refer to FIG. 5, showing an unfastening illustration, when the USB metallic plug of an external device of the invention is unplugged from a USB connector. As shown in this figure, when the external device 4 is not used any more, user can open the shell of the electronic device 4 and insert a tool 5 into the opening 233 of the fastening piece 23. After the tool 5 abuts against the abutting part 234 and pushes up the fastening part 231 at the front of the fastening piece 23, the fastening part 231 of the fastening piece 23 leaves the perforation 43 of the USB metallic plug 41. Thereby, the USB metallic plug 41 of the external device 4 can be extracted from the opening 21 of the USB connector.

Figure 6:
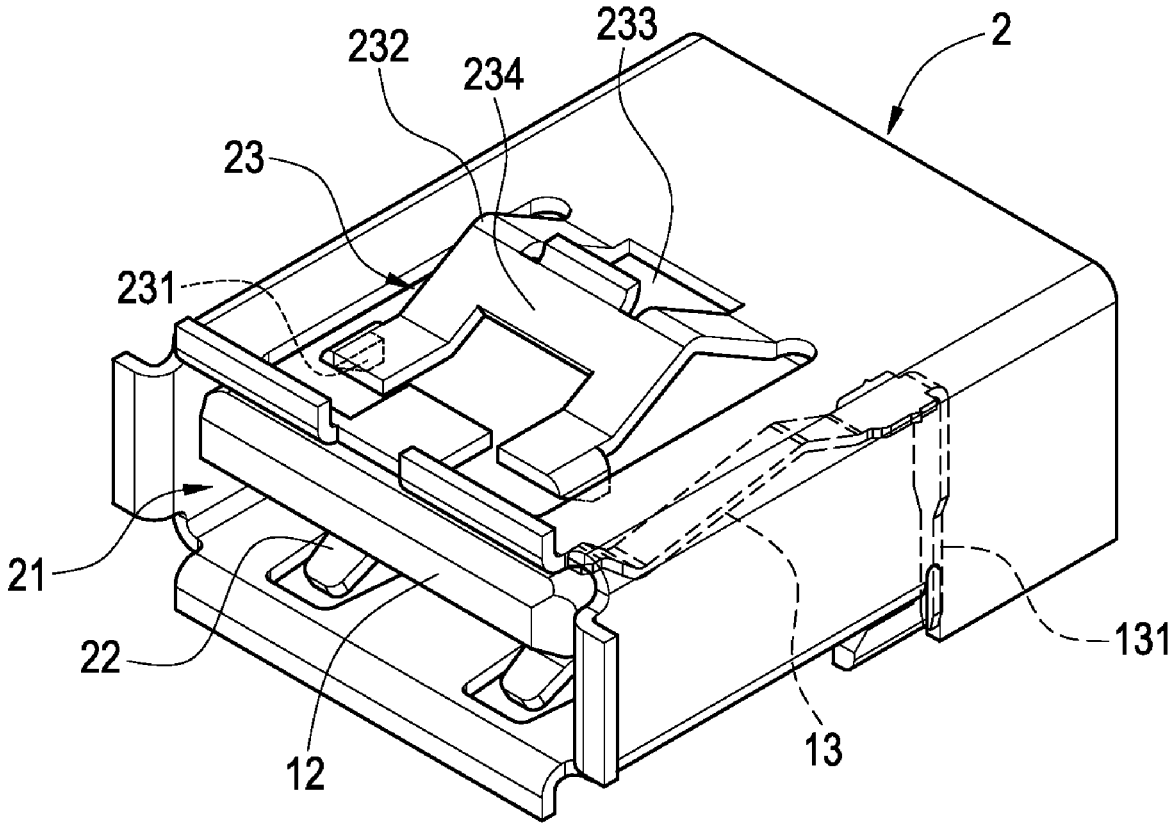
FIG. 6 is an outer illustration of another embodiment of the invention.
Figure 7:
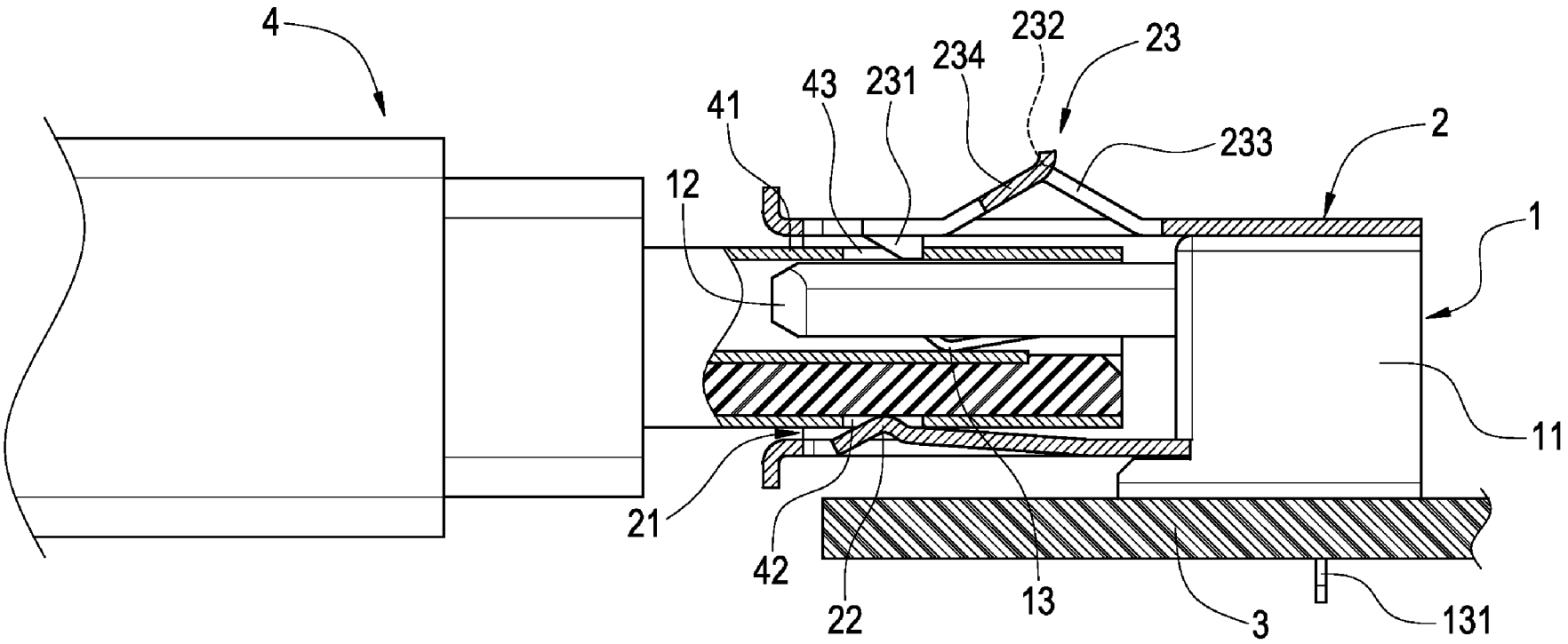
FIG. 7 is an assembled illustration of FIG. 6.
Figure 8:
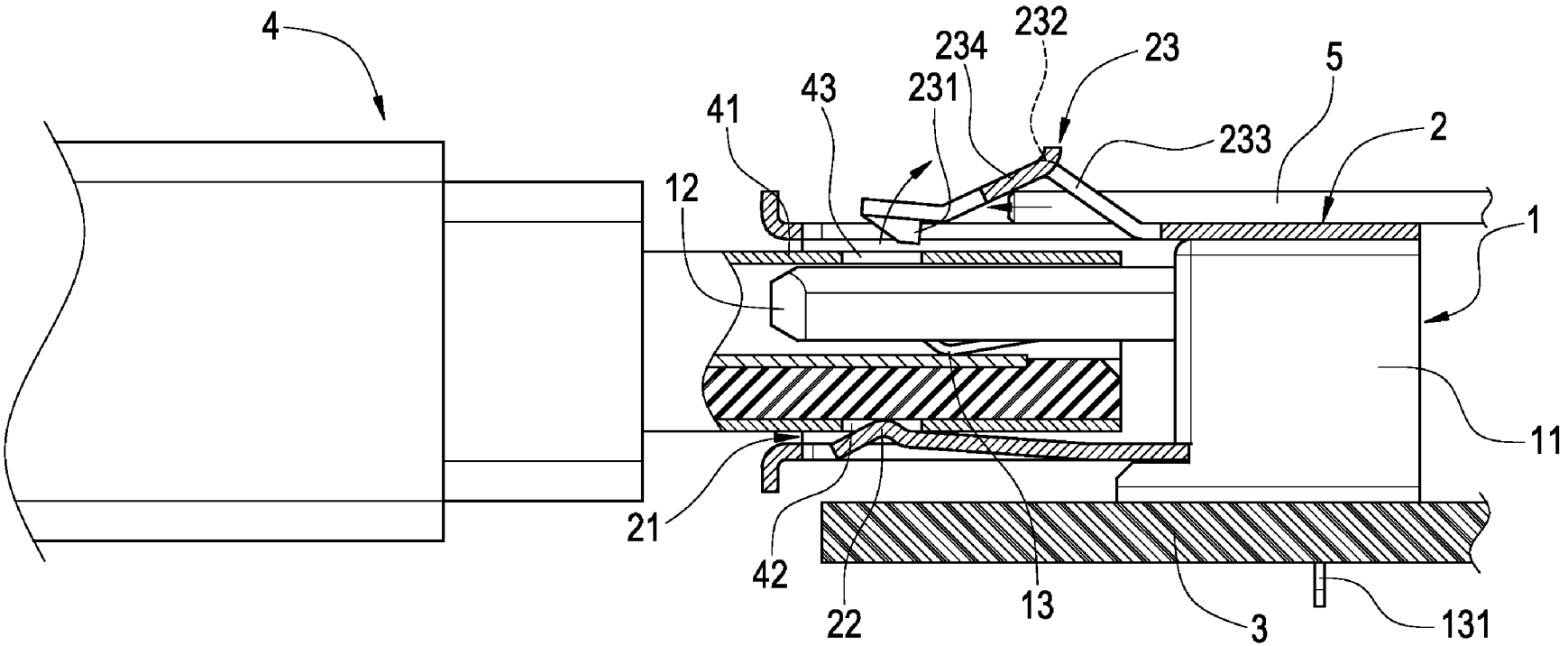
FIG. 8 is an illustration showing an unfastening state of FIG. 7.

Please refer to FIG. 6 through FIG. 8, separately showing an outer illustration of another embodiment of the invention, an assembled illustration of FIG. 6 and an unfastened illustration of FIG. 7. As shown in these figures, this second embodiment is mainly to switch the positions of the opening 233 and the abutting part 234 on the fastening piece 23. After the tool 5 is inserted into the opening 233 of the fastening piece 23 from a back direction of the USB connector, the tool 5 is abutted against the abutting part 234, such that the fastening part 231 at the front of the fastening piece 23 is pushed up. Finally, the fastening part 231 of the fastening piece 23 leaves the perforation 43 of the USB metallic plug 41.

Therefore, through the constitution of aforementioned assemblies, a USB connector capable of extraction proof according to the present invention is thus obtained.

Summarizing aforementioned description, the USB connector capable of extraction proof according to the present invention is an indispensable device for a computer connected an external device indeed, which may positively reach the expected usage objective for solving the drawbacks of the prior arts, and which extremely possesses the innovation and progressiveness to completely fulfill the applying merits of a new type patent, according to which the invention is thereby applied. Please examine the application carefully and grant it as a formal patent for protecting the rights of the inventor.

However, the aforementioned description is only a number of preferable embodiments according to the present invention, not used to limit the patent scope of the invention, so equivalently structural variation made to the contents of the present invention, for example, description and drawings, is all covered by the claims claimed thereinafter.

What is claimed is:

1. A USB connector capable of extraction proof, including:

an insulation seat which has a base, one side of which is extended a tongue, on which a plurality of conductive legs are disposed, another side of each of which passes through the base and extends out of the base; and a metallic shell which is shown as a hollow configuration and assembled to the base, and which is fitted onto the tongue to form a connection opening, and on a top face of which a fastening piece is arranged;

characterized in that after a USB metallic plug of an external device is plugged in the USB connector, two fastening parts formed at front of the fastening piece buckle into two perforations of the USB metallic plug, respectively, and the fastening piece further comprises a bending formed with an opening and an abutting part such that the fastening parts are unbuckled from the perforations of the USB by using an external tool being inserted into the opening and pushing against the abutting part.

2. The USB connector capable of extraction proof according to claim 1, wherein a plurality of leaf springs are arranged at a bottom of the metallic shell.

3. The USB connector capable of extraction proof according to claim 2, wherein the fastening piece is shown like a rake or a "<" shape, and the fastening part is shown as a barb.

4. The USB connector capable of extraction proof according to claim 3, wherein the bending part is shown like a "<" shape.

* * * * *